US008157500B1

(12) United States Patent
Husmann

(10) Patent No.: US 8,157,500 B1
(45) Date of Patent: Apr. 17, 2012

(54) FORKLIFT TILT DIRECTION INDICATOR

(76) Inventor: Shawn M. Husmann, Aurora, MO (US)

( * ) Notice: Subject to any disclaimer, the term of this patent is extended or adjusted under 35 U.S.C. 154(b) by 139 days.

(21) Appl. No.: 12/843,019

(22) Filed: Jul. 24, 2010

Related U.S. Application Data

(60) Provisional application No. 61/231,208, filed on Aug. 4, 2009.

(51) Int. Cl.
*B66F 9/08* (2006.01)

(52) U.S. Cl. ..... 414/635; 414/642

(58) Field of Classification Search ..... 414/634–636, 414/641–642; 187/226, 230; 212/277; 33/DIG. 15, 33/706, 707, 708, 333, 365, 366.11; 92/5 R, 92/5 L; 91/1
See application file for complete search history.

(56) References Cited

U.S. PATENT DOCUMENTS

| | | | | | |
|---|---|---|---|---|---|
| 3,198,360 | A * | 8/1965 | Strader et al. | 414/701 |
| 3,312,361 | A | 4/1967 | Foster | |
| 3,319,816 | A * | 5/1967 | Christenson | 414/636 |
| 3,865,265 | A | 2/1975 | Brudi et al. | |
| 3,883,021 | A | 5/1975 | Wilhelm | |
| 4,411,582 | A * | 10/1983 | Nakada | 414/636 |
| 5,052,273 | A * | 10/1991 | Sakaguchi | 92/5 R |
| 5,088,879 | A * | 2/1992 | Ranly | 414/636 |
| 5,131,801 | A | 7/1992 | Melanson | |
| D351,111 | S | 10/1994 | Sheakley | |
| 5,749,696 | A | 5/1998 | Johnson | |
| 6,253,460 | B1 * | 7/2001 | Schmitz | 33/706 |
| 6,327,791 | B1 * | 12/2001 | Norcross et al. | 33/706 |
| 6,427,576 | B1 * | 8/2002 | Bock et al. | 92/5 R |
| 6,941,666 | B2 | 9/2005 | Parish | |
| 6,981,331 | B1 | 1/2006 | Poe, Jr. et al. | |
| 7,051,639 | B2 * | 5/2006 | Krone et al. | 91/1 |
| 7,178,446 | B2 * | 2/2007 | Kucher et al. | 91/1 |
| 2008/0202856 | A1 | 8/2008 | Fossier et al. | |
| 2009/0114485 | A1 | 5/2009 | Eggert | |

* cited by examiner

*Primary Examiner* — Gregory Adams
*Assistant Examiner* — Jonathan Snelting
(74) *Attorney, Agent, or Firm* — Richard L. Marsh

(57) ABSTRACT

A device for determining the orientation of a fork on a forklift has an indicating rod adjustably attached to the fork assembly which passes through a electrical contact switch assembly mounted to the cylinder which in turn is rigidly attached to the cylinder of the piston assembly and is comprised of electrical contactors that are activated by the indicating rod that indicates to the forklift operator with an orientation of the forks relative to the wheel base.

20 Claims, 7 Drawing Sheets

FORKLIFT TILT DIRECTION INDICATOR

RELATED APPLICATION DATA

This application is a non-provisional application of Applicant's provisional application Ser. No. 61/231,208 filed on 4 Aug. 2009, the entirety thereof incorporated into this application by this reference thereto.

BACKGROUND OF THE INVENTION

1. Field of the Invention

The present invention relates to a device that will indicate the tilt of the forks of a forklift. Individual lights may be used to indicate forward, level or back position to give the operator of the forklift a clearer indication of the position of the forks.

2. Prior Art Statement

Industrial forklift trucks are generally comprised of a wheeled chassis having an operator compartment, a forward mounted, upwardly directed mast and a means for moving the truck. The operator compartment contains operating controls and a seat for an operator. The forward mounted, upwardly directed mast is tiltable relative to the wheeled chassis by an hydraulic cylinder and carries a pair of forward directed forks which are mounted for vertical sliding movement along the mast. The forks are adapted to be inserted within a pallet base that supports a load to be carried and positioned by the forklift. Preferably, the forks are maintained in a generally horizontal level orientation to prevent damage to the product, the pallet, the forklift or to prevent injury to workmen. It is also important to essentially maintain the forks in a generally horizontal level orientation while positioning a pallet on a stack of pallets in order to ensure proper fit on the top of the stack and eliminate the possibility of capsizing the stack of pallets.

Wooden pallets are often used as supports and to separate stacked items by a space into which the fork of the forklift is inserted in order to move the pallet and the load thereupon. The insertion between the pallets is usually effected by driving the forklift forward so that the forks slide between the pallets. The fork is then lifted to raise the upper pallet and the objects thereon. When articles are stacked upon one another using wooden pallets, inserting the forks between layers requires that the fork be properly positioned both with respect to height and tilt angle of the fork. The tilt angle of the fork is important for correct and trouble free sliding under the pallet. With wooden pallets, the fork is inserted into an opening in the pallet between two layers of stacked objects. When the angle is incorrect, the rigidity of the pallet can cause the fork to get stuck or the fork may pierce the goods placed upon a pallet or may push a pallet off a stack. These problems may occur whether the angle of the fork is tilted too far forward or too far backward so getting the tilt angle correct for fork insertion between pallets is critical and requires substantial practice. Height of the fork from a base surface is relatively easy as the tip of the fork may be readily observed by the operator but the angle of the fork is far more difficult because the operator is not well positioned for visually determining the tilt angle.

When the forklift truck is transporting a load on an inclined surface, it may be further necessary to adjust the angular position of the mast to bring the forks to a more horizontal position. Additionally, in operations where the forks are at a very high elevation, it may be necessary to adjust the angle of the mast to maintain the center of gravity of the loaded truck within safe operating limits.

In view of these concerns, level indicating devices operating on a plumb bob principle that indicate the position of the forks relative to a true vertical have been developed for forklifts. For instance, see U.S. Pat. No. 3,312,361 issued on 4 Apr. 1967 to Foster; U.S. Pat. No. 3,865,265 issued on 11 Feb. 1975 to Brudi, et al., and U.S. Pat. No. 3,883,021 issued on 13 May 1975 to Wilhelm. These devices often produced inaccurate indications due to foreign matter, physical damage and/or lateral movement of the forklift relative to the vertical plane. Therefore, there is a great need for a forklift fork indicating device that indicates the position of the forks relative to the wheel base.

Improvements have been made to pendulum type indicator by protecting the swinging pendulum which pivots on a post attached to the mast. The pendulum also has an indicating arm attached to its upper end at the pivot which extends toward the rear of the mast so it is observed by the operator. A sliding pointer near the rear face of the mast has a pin protruding through a slot in the indicating arm so that when the mast moves the sliding pointer moves in concert with the direction of movement of the mast. For instance, see the U.S. Pat. No. 6,941,666 B2 issued on 13 Sep. 2005 to William J. Parish. Maintenance has been found to be significant with the pendulum and inaccuracies have been observed as with older pendulum types.

A further improvement in pendulum devices is found in U.S. Pat. No. 6,981,331 B1 issued on 3 Jan. 2006 to Poe, Jr., et al. Poe, Jr., et al., provide a magnetically dampened device that is affixed to the upright column of the fork assembly, however, it has been found that inaccuracies still occur during transit and lateral movements. Furthermore, as with all pendulum indicators, the indicator actually indicates the position of the forks relative to a true vertical which leads to inaccuracies on inclined surfaces. Therefore, there is a great need for a fork position indicator that indicates a fork attitude relative to the surface upon which the fork lift is placed.

It has been known to provide an extension to the cylinder which receives a movable connector in the free end thereof wherein the movable connector is rotatably attached to a variable potentiometer fixed to the fork assembly frame. The angle of the fork relative to the frame is displayed to an operator on an indicator preferably mounted in a position where the operator can view both the height of the fork and the angle indicator. For instance, see the U.S. Pat. No. 5,131,801 issued on 21 Jul. 1992 to Clayton C. Melanson. It has been found that the variable potentiometer and the movable connector are subject to damage as the components insufficiently robust and exposed to the forklift environment. Therefore, there is still a need for an indicating device for a forklift that is robust and generally protected from damage.

Another prior art device provides a finger on the upright bar which touches one of the limit switches when the mast reaches either a maximum forward or rearward angle. It is assumed that the upright bar and finger are associated with the cylinder and the limit switches are affixed to the fork frame. The two electric eyes are assumed to determine maximum right and left side shifting of the forks. For instance, see U.S. Design Pat. No. D 351,111 issued on 4 Oct. 1994 to John W. Sheakley. The device only indicates the maximum forward and rearward positions and cannot indicated a level condition. Therefore, there is still a need for a fork position indicator that indicates a fork attitude relative to the surface upon which the fork lift is placed including indicating a null position where the mast is perpendicular to the forklift surface.

It is further known to provide a forklift indicating device which contains an electronic bubble level sensors such as an opto-electronic leveling device that accurately determines the position of the bubble. For instance, see U.S. Publication 2009/0114485 A1 published on 7 May 2009 to Richard T. Eggert. Such a device is extremely expensive to manufacture and therefore not within the reach of many forklift owners. Thus, a need now exists for a simple, robust and accurate fork position indicator that indicates a fork attitude relative to the surface upon which the fork lift is placed including indicating a null position.

Also known is a device provided with a plurality of Hall effect transistors arranged linearly along a box affixed to the tilt cylinder. A rod or tape passes alongside the Hall effect transistors and carries a magnet which causes a Hall effect transistor to change state when the magnet passes nearby. The transistors are arranged to indicate a tilt angle of the mast. For instance, see the U.S. Pat. No. 5,749,696 issued on 12 May 1998 to Marc Johnson. Though apparently accurate, providing a plurality of Hall effect sensors is also extremely expensive and not widely used. A need still exists for a simple, robust and accurate fork position indicator that indicates a fork attitude relative to the surface upon which the fork lift is placed including indicating a null position.

Finally, it is known to provide an electronic sender/receiver which sends out a signal that is reflected by a reflector mounted on the operator side of the mast. The degree of inclination is determined by the distance of the reflector from the sender/receiver. For instance, see the U.S. Publication 2008/0202856 A1 published on 28 Aug. 2008 to Fossier, et al. Movement of the reflector corrupts the signal reflection resulting in inaccuracies. The cost of the electronics may also be significant. Accordingly, a simple, robust and accurate fork position indicator which comprises a simple operator indicator, at least one switch, an indicator rod and a mounting lug wherein the indicator rod is greatly needed.

SUMMARY OF THE INVENTION

One object of this invention is to provide a forklift fork indicator device to indicate when the forks of a forklift are parallel with the wheel base.

Another object of this invention is to provide a forklift fork indicator incorporating an electrical, mechanical or electromechanical switch.

A primary goal of this invention is to provide forklift with a fork indicating device.

A significant feature of this invention is to provide a forklift fork indicator device to indicate the forward pitch or the rearward pitch of the forks.

A main purpose of this invention is to provide a visual operator indicator operable with a forklift indicator switch wherein the visual indicator may be a single light or a series of lights that change when the forklift angle crosses boundaries of a preset range.

A primary principle of this invention is to provide an audible operator indicator operable with a forklift indicator switch wherein the audible indicator that changes frequency and/or amplitude when the forklift angle enters a boundaries of a preset range.

A principal aim of this invention is to provide operator adjustable preset limits for an audible or visual indicator of a forklift fork position indicator device.

A primary aspect of this invention is to provide a forklift fork position indicator comprising an operator indicator, a switch, an indicator rod and a mounting lug wherein the indicator rod has a central cylindrical portion and machine grooves extending in opposite directions therefrom.

A major goal of this invention is to provide a fork positioning indicator for a fork lift that is generally protected by being mounted adjacent and operable with the piston of the cylinder.

DESCRIPTION OF THE PREFERRED EMBODIMENTS

Figure 1:
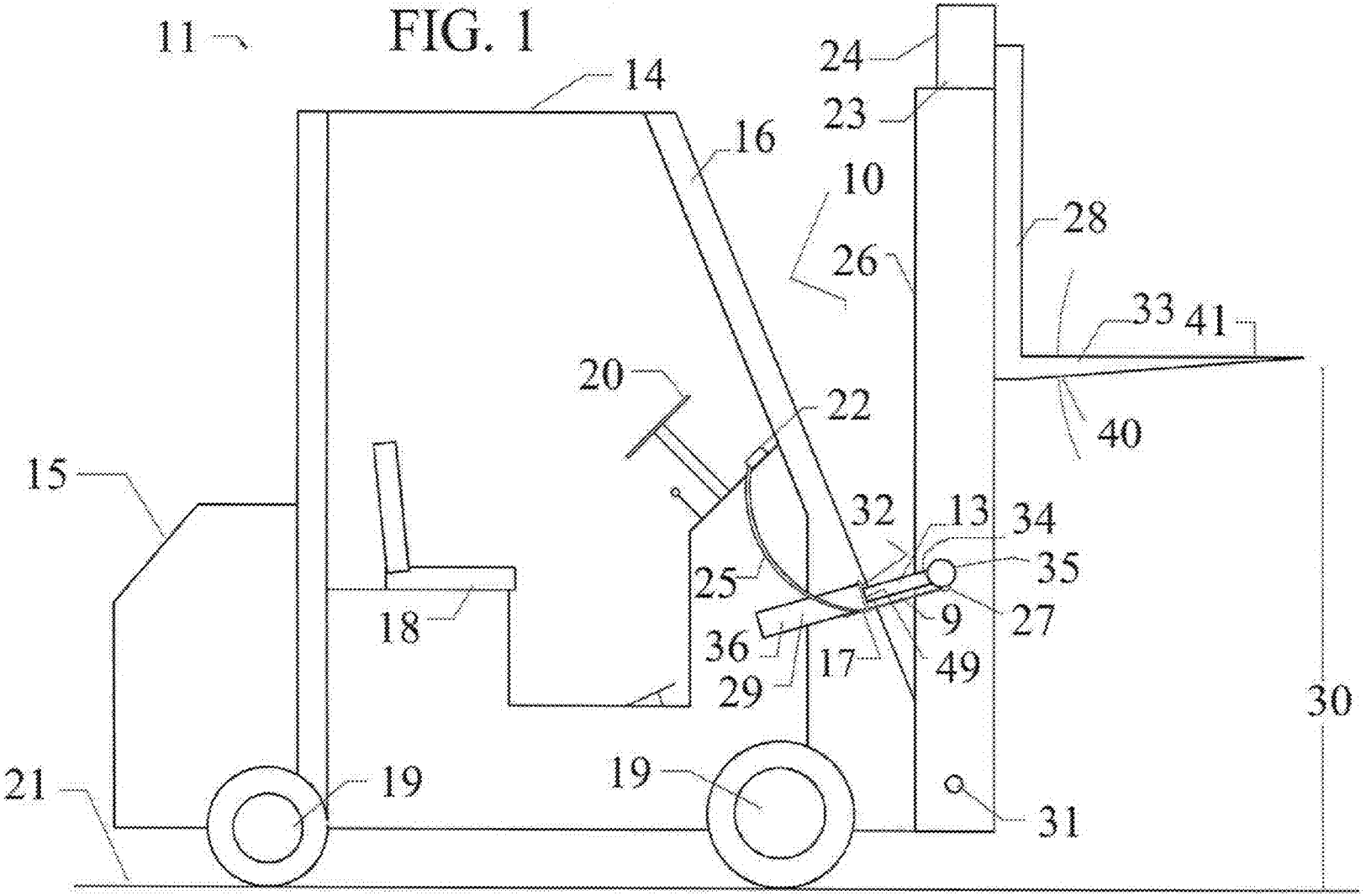
FIG. 1 is a side plan view of a forklift and a fork tilt indicating device of this invention.
Figure 2:
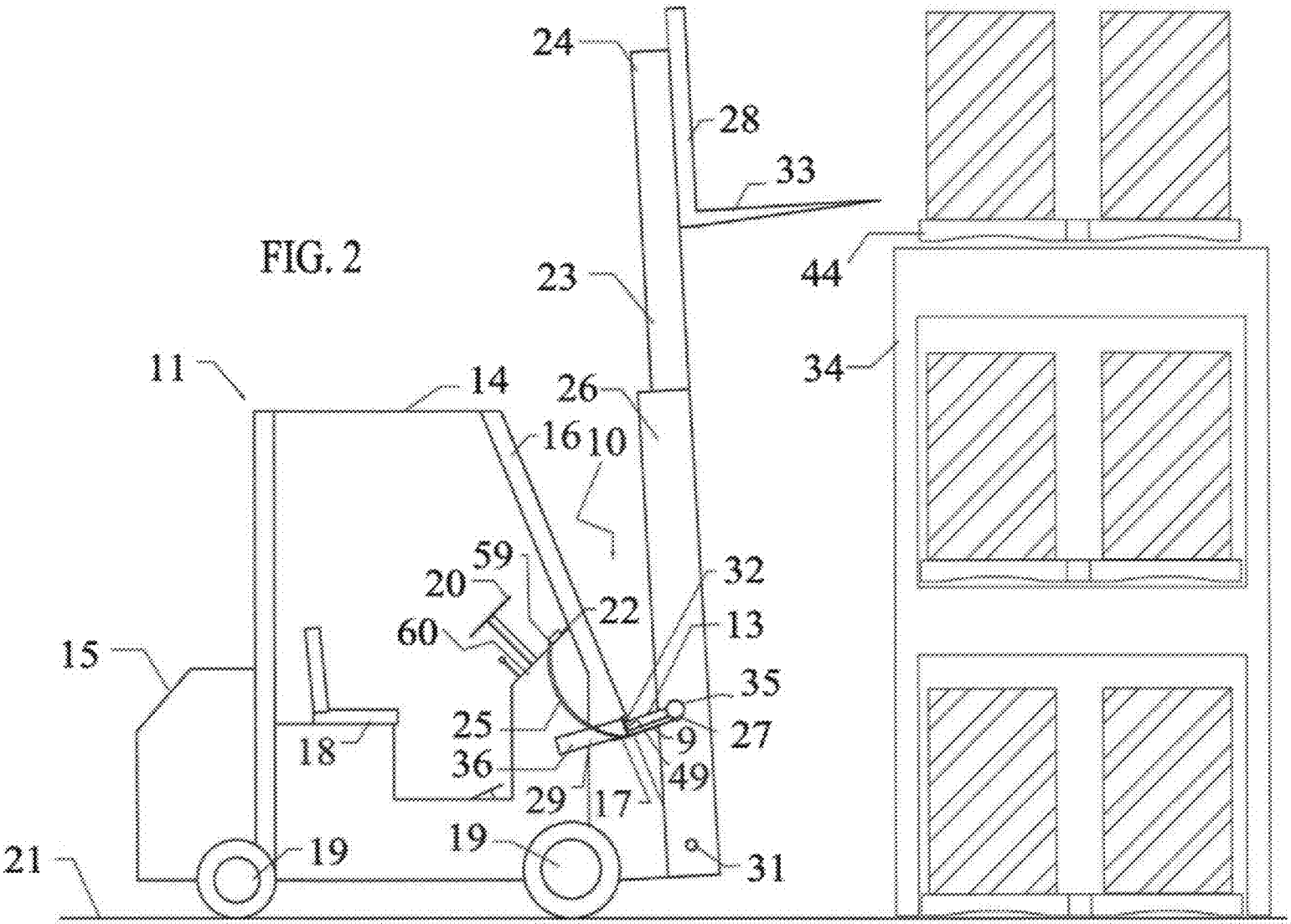
FIG. 2 is a side plan view of the embodiment of FIG. 1 showing the forks in an elevated position.

Referring now to the FIGS. 1 and 2, a device for determining vertical orientation of a fork of a forklift is generally shown by the numeral 10, device 10 associated with a forklift 11 is illustrated. Forklift 11 operates on a surface 21 such as a floor and is generally used to lift, move and reposition pallets 44. Wooden pallets 44 are often used as supports and to separate stacked items in a pallet stack 72 by a space into which the fork 28 of forklift 11 is inserted in order to move pallet 44 and the load thereupon. The insertion between pallets 44 in stack 72 is usually effected by driving forklift 11 forward so that forks 28 slide between pallets 44. Fork 28 is then lifted to raise the upper pallet 44 and the objects thereon. In a pallet stack 72, inserting forks 28 between pallets 44 requires that fork 28 be properly positioned both with respect to height and tilt angle 40 of fork 28 as the tilt angle 40 of fork 28 is important for correct and trouble free sliding under pallet 44. When angle 40 is incorrect, the rigidity of pallet 44 can cause fork 28 to get stuck or fork 28 may pierce the goods placed upon pallet 44 or may push pallet 44 off stack 72. Forklift 11 comprises a frame 16, an operator compartment 14, a prime mover 15 and surface engaging wheels 19, operator compartment 14 having a seat 18 and a steering wheel 20 at which the operator sits and operates forklift 11. Attached to vehicle frame 16 is a fork assembly 24 having a column 26 along which fork 28 may be raised or lowered to a desired height 30. A tilt angle 40 of tines 33 of fork 28, as measured from a horizontal 41, is adjustable. A number of different mechanisms to adjust tilt angle 40 of fork 28 are available, but a preferred mechanism is with a pivot 31, coupling forklift assembly 24 to vehicle frame 16, and a tilting piston assembly 36 coupling vehicle frame 16 to column 26 which caused fork 28 to tilt as column 26 rotates about pivot 31. A tilt indicator 22 is mounted in operator compartment 14 to indicate to the operator a tilt position, or tilt angle 40 of fork 28. Device 10 comprises tilt indicator 22, a contactor switch assembly 17, a mounting lug 27, connecting wires 25 and an indicator rod 9, the construction and function thereof to be hereinafter fully described. Fork assembly 24 is pivotally attached to frame 16 as at pivot 31, fork assembly 24 further comprising column 26, a telescoping structure 23 and a pair of forks 28, pair of forks 28 movable upon telescoping structure 23 wherein telescoping structure 23 is also moveable upon column 26 to provide higher elevated lifting of forks 28 as shown in FIG. 2. Piston assembly 36 comprises a piston 13 and a cylinder 29, cylinder 29 pivotally attached to frame 16, piston 13 having one end 32 longitudinally movable within cylinder 29 and an opposite end 34 of piston 13 coupled to fork assembly 24 with a pivotable coupling 35. As hereinbefore stated, device 10 comprises indicating rod 9, contactor switch assembly 17, tilt indicator 22, mounting lug 27 and connecting wires 25 wherein connecting wires 25 electrically connect contactor switch assembly 17 to tilt indicator 22. Device 10 may also have an integral power source, not shown, or may receive power from prime mover 15 or its associated electrical storage.

Figure 3:
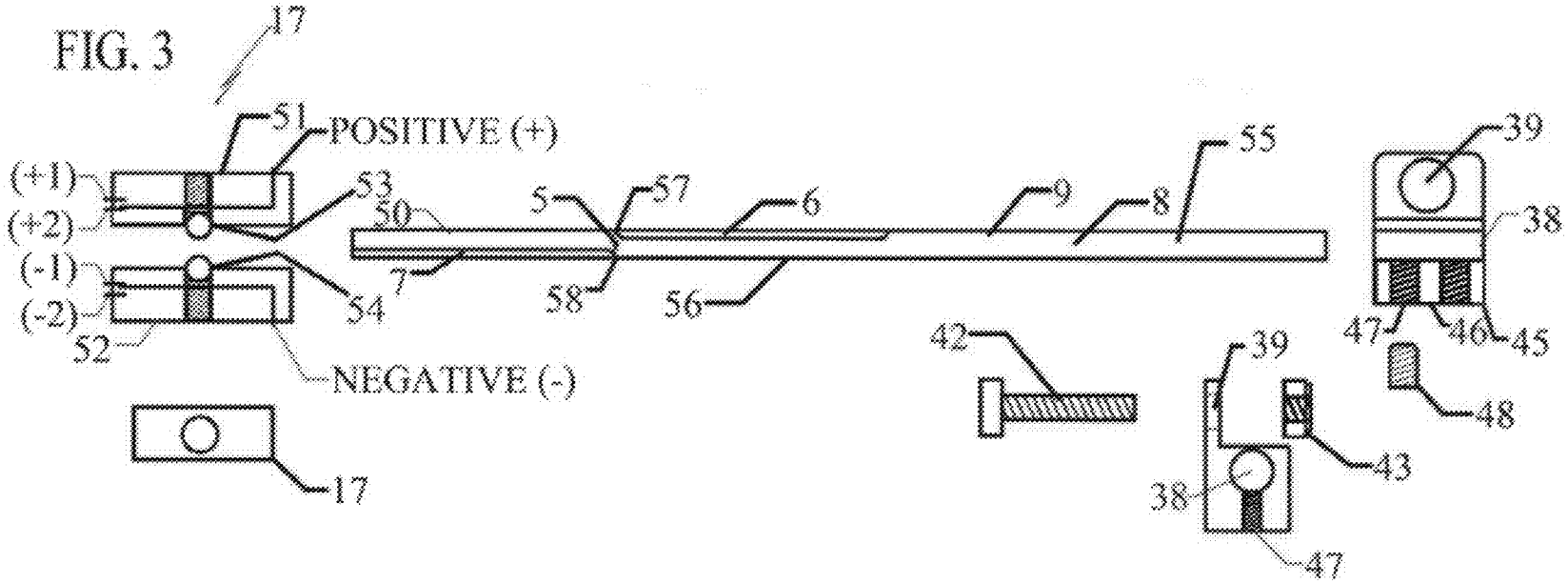
FIG. 3 is an enlarged view of the indicating rod and the electrical contact switch assembly of the tilt indicating device employed in FIG. 1.

Referring also to FIG. 3, mounting lug 27 has a hole 38 disposed longitudinally therethrough for receiving indicating rod 9 therein, mounting lug 27 affixed to pivotable coupling 35 with a bolt 42 passing through a retaining bolt hole 39 disposed through mounting lug 27 at a right angle to hole 38, bolt 42 threadedly received in a nut 43. Mounting lug 27 may be bifurcated from hole 38 through a base 45 thereof with a slit 46 wherein bolt 42, when tightened with nut 43 firmly clamps mounting lug 27 to indicating rod 9 as well as affixing mounting lug 27 to pivotable coupling 35. Base 45 of mounting lug 27, however, is preferably provided with set screw holes 47 disposed therein, set screw holes 47 bored through to hole 38 and threaded for receiving set screws 48 therein wherein set screws 48 retain indicating rod 9 at a selected position in hole 38. Indicating rod 9 is provided with a central cylindrical portion 5, a forward tilt groove 7, a rearward tilt groove 6 and an forward end portion 8, forward end 8 adjustably attached to pivotable coupling 35 in mounting lug 27 wherein it should be readily apparent therefore, that indicating rod 9 may be adjusted in position relative to mounting lug 27 by loosening set screws 48, repositioning indicating rod 9 to a desired position and then re-tightening set screws 48 as will become hereinafter described in a use of device 10. Forward tilt groove 7 is disposed aft of central cylindrical section 5, that is, toward an open end 50 of indicating rod 9 while rearward tilt groove 6 is disposed between central cylindrical portion 5 and forward end portion 8 wherein forward end portion 8 is adapted to be received in hole 38 of mounting lug 27. Central cylindrical portion 5 may be very short in length as shown in FIG. 3 to indicate a rapid transition from one direction of tilt to the opposite direction, however, central cylindrical portion 5 may be slightly extended in length to provide for an "off" position for electrical contact switches 51, 52. Forward tilt groove 7 is preferably disposed diametrically opposite rearward tilt groove 6 to provide for diametrically opposed mounting of electrical contact switches 51, 52 within contactor switch assembly 17, however, it should be readily apparent that other orientations of grooves 6, 7 and electrical contact switches 51, 52 are fully within the scope of this invention.

Figure 4:
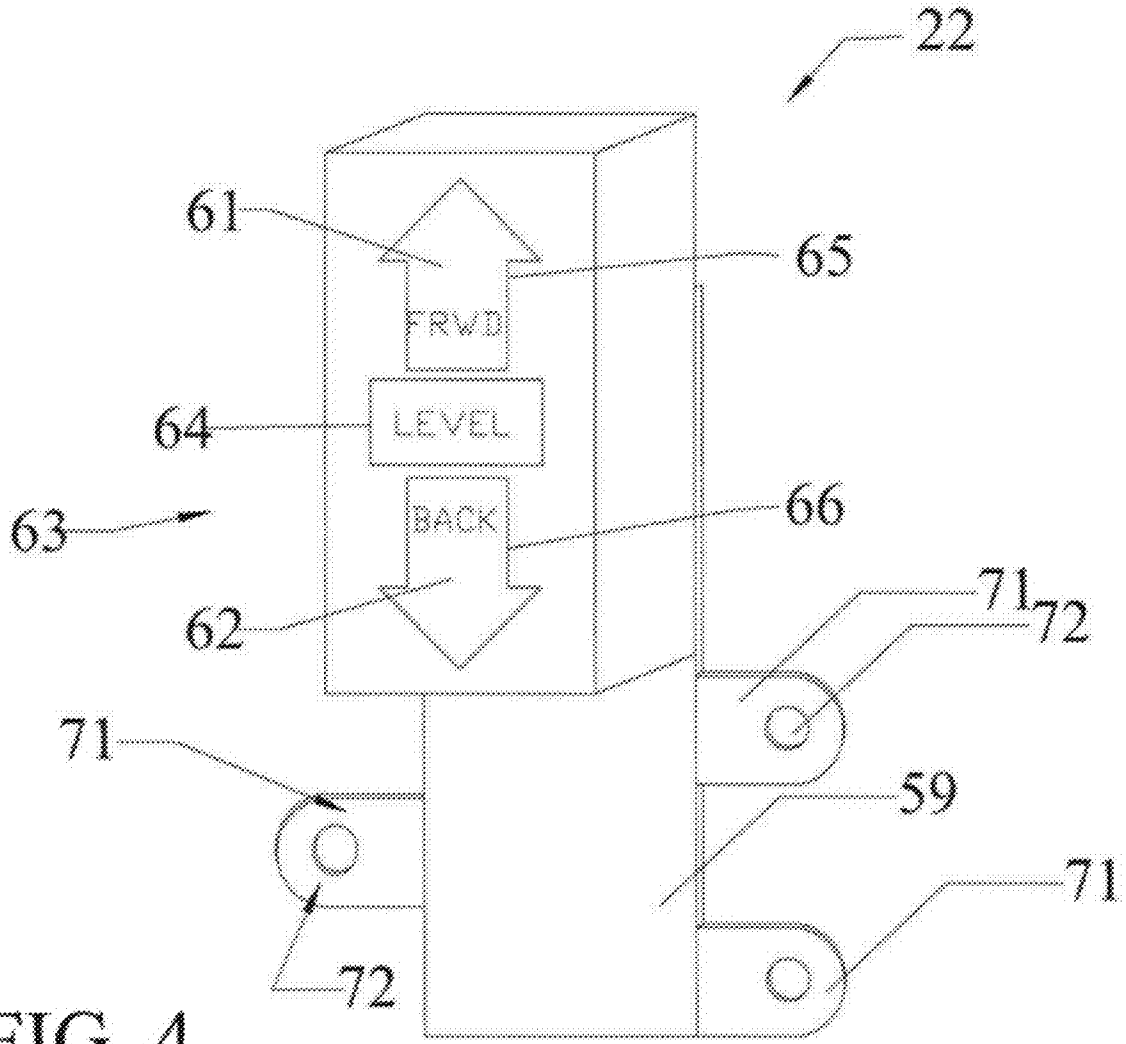
FIG. 4 is a preferred arrangement of a tilt indicator of the device of this invention.

Continuing to refer to FIG. 2 yet in conjunction with FIGS. 1 and 3, contactor switch assembly 17 is rigidly mounted to cylinder 29 by any suitable means available, contactor switch assembly 17 preferably mounted adjacent an end 49 of cylinder 29 such that indicating rod 9 is disposed parallel to piston 13 and passing through contactor switch assembly 17. Mounting of contactor switch assembly 17 adjacent end 49 of cylinder 29 provides a measure of protection for contactor switch assembly 17 as cylinder 29 is generally provided with an end collar of greater size than cylinder 29. Tilt indicator 22 of vertical orientation device 10 is mounted in operator compartment 14 in full view of the operator and electrically coupled to contactor switch assembly 17 with connecting wires 25, tilt indicator 22 providing an operator of forklift 11 with an orientation of forks 28 relative to a surface 21 engaged by surface engaging wheels 19. Though tilt indicator 22 may be located anywhere within operator compartment 14, preferably, tilt indicator 22 is mounted to a bracket 59 as in FIG. 4, bracket 59 extending upwardly from a front edge of vehicle frame 16 and raised above dash board 60 of forklift 11 such that tilt indicator 22 is readily visible to the operator substantially in a plane as the operator would observed the forks when lying upon surface 21. Bracket 59 is affixed to vehicle frame 16 with bolts through bolt holes 72 in ears 71. Though the preferred mounting of tilt indicator 22 is shown in FIG. 4, tilt indicator may be affixed directly to dashboard 60 with screws 70 passing through tilt indicator 22 into dashboard 60. Alternately, tilt indicator 22 may be fixed to a bracket 59' of FIG. 6 similar to bracket 59 of FIG. 4 wherein ears 71 project rearwardly from bracket 59' and are affixed to a side edge of vehicle frame 16 with bolts through bolt holes 72. In yet another mounting embodiment shown in FIG. 7, bracket 59" may be a channel which fits around a columnar frame member of vehicle frame 16 with ears 71 adapted to receive bolts through bolt holes 72. Tilt indicator 22 may comprise a single light adapted to change color relative to a position of said indicating rod, a pair of lights disposed one above the other, an audible signal relative to a position of said indicating rod, a plurality of lights arranged in a vertical column containing a null section or a plurality of lights arranged in a vertical column containing a central light.

Referring now to contactor switch assembly 17 in FIG. 3, contactor switch assembly 17 comprises electrical contactors 51, 52 disposed in opposed relationship, electrical contactors 51, 52 provided with followers 53, 54 respectively. Electrical contact switch 51 has follower 53 adapted to travel on indicator rod 9 diametrically opposite follower 54 of electrical contact switch 52 and wherein follower 53 of electrical contact switch 51 is aligned with said forward tilt groove 7 and follower 54 of electrical contact switch 52 is aligned with rearward tilt groove 6. When follower 53 of electrical contact switch 51 is disposed upon a full surface 55 of open end 50, follower 54 of electrical contact switch 52 is disposed in forward tilt groove 7 of indicating rod 9 thus sending a signal to tilt indicator 22 that forks 28 are tilted in a forward direction as indicating rod 9 has central cylindrical portion 5 moved to a position between end 49 of cylinder 29 and pivotable coupling 35. Likewise, when follower 54 of electrical contact switch 52 is disposed upon a full surface 56 opposite rearward tilt groove 6, follower 53 of electrical contact switch 51 is disposed in rearward tilt groove 6 of indicating rod 9 thus sending a signal to tilt indicator 22 that forks 28 are tilted in a rearward direction as central cylindrical portion 5 no longer occupies a position between end 49 of cylinder 29 and pivotable coupling 35 but rather inwardly of followers 53, 54. When follower 53 of electrical contact switch 51 is disposed at a transition point 57 between full surface 55 of open end 50 and forward tilt groove 7 and follower 54 of electrical contact switch 52 is disposed at a transition point 58 between full surface 56 of forward end portion 8 and rearward tilt groove 6, either no signal is sent to tilt indicator 22 or a signal is sent to tilt indicator 22 depending upon wiring of electrical contact switches 51, 52 and a type of tilt indicator 22 installed.

For instance, referring now to FIG. 4, where tilt indicator 22 is provided with three lights 61, 62, 64 arranged in a vertical column, a top light 61 may comprise an upwardly curved arrow 65 indicating that forks 28 are tilted back from a vertical position. Likewise, a downwardly curved arrow 66 may constitute a bottom light 62, downwardly curved arrow 66 indicating that forks 28 are tilted downwardly from a vertical. A central section 63 would then contain central light 64 to indicate that forks 28 are neither tilted backwardly or forwardly. Central light 64 may be square, round or any other shape and since lights 61, 62, 64 are preferably a translucent thermoplastic material provided with a light source mounted within tilt indicator 22, each of lights 61, 62, 64 may further have indicia printed thereupon which is back lighted by the light source behind lights 61, 62, 64 wherein top light 61 would be provided with a word such as "back," "up" or the like while bottom light 62 would be provided with a word such as "down," "forward" or the like and central light 64 would carry a word such as "central," "vertical," "level" or the like.

Figure 5:
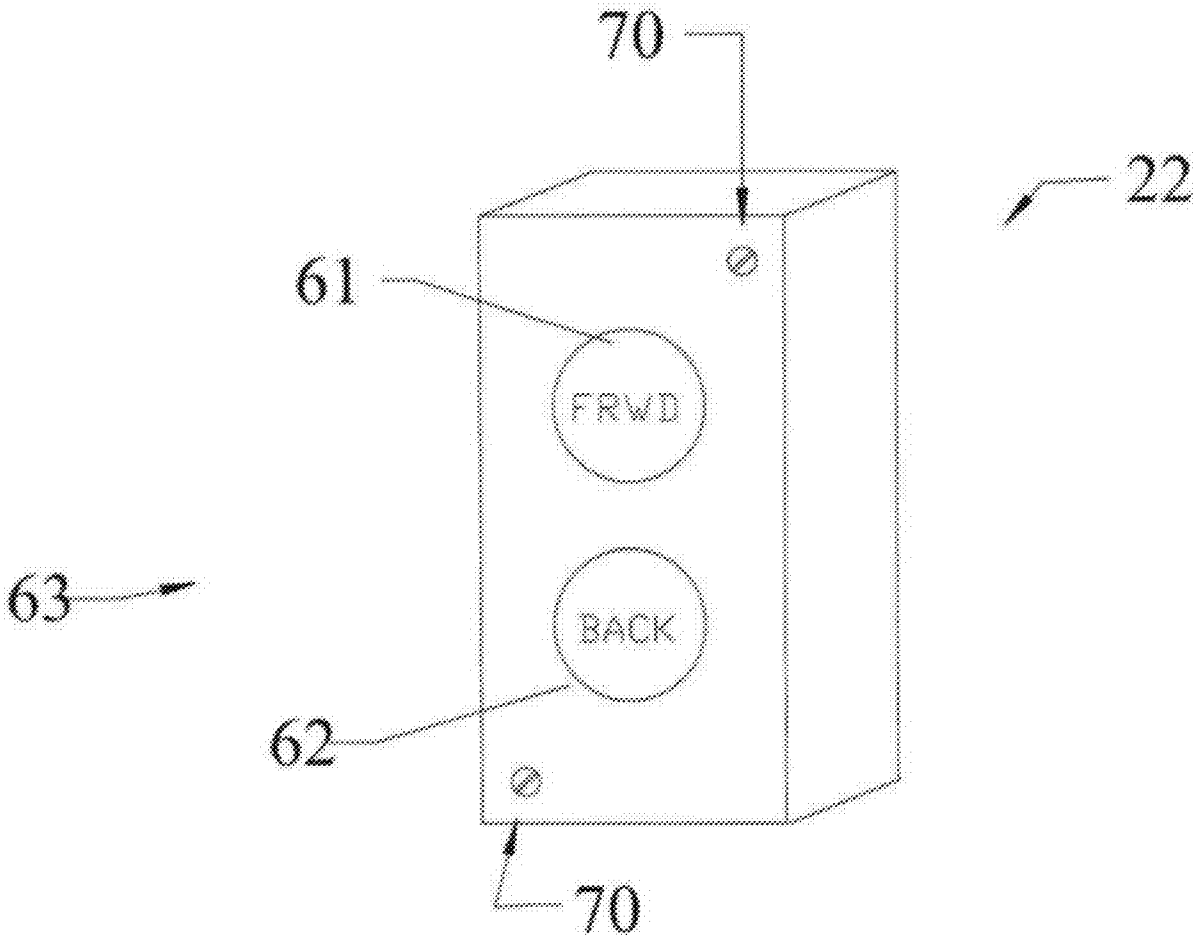
FIG. 5 is an alternate arrangement of a tilt indicator of the device of this invention.

Referring now to FIG. 5, where tilt indicator 22 is provided with only two lights 61, 62, light 61 arranged above light 62, top light 61 will be lighted when forks 28 are tilted back from a vertical position while bottom light 62 would only be lighted when forks 28 are tilted downwardly from a vertical. Central section 63 would then comprise a null section where no light is provided and the operator would know that when neither light 61 or 62 is lighted, forks 28 are substantially level with surface 21 upon which wheels 19 of forklift 11 are riding. As described above with respect to a three light system for tilt indicator 22, lights 61, 62 may further have indicia printed thereupon which is back lighted by the light source behind lights 61, 62 wherein top light 61 would be provided with a word such as "back," "up" or the like while bottom light 62 would be provided with a word such as "down," "forward" or the like.

Figure 6:
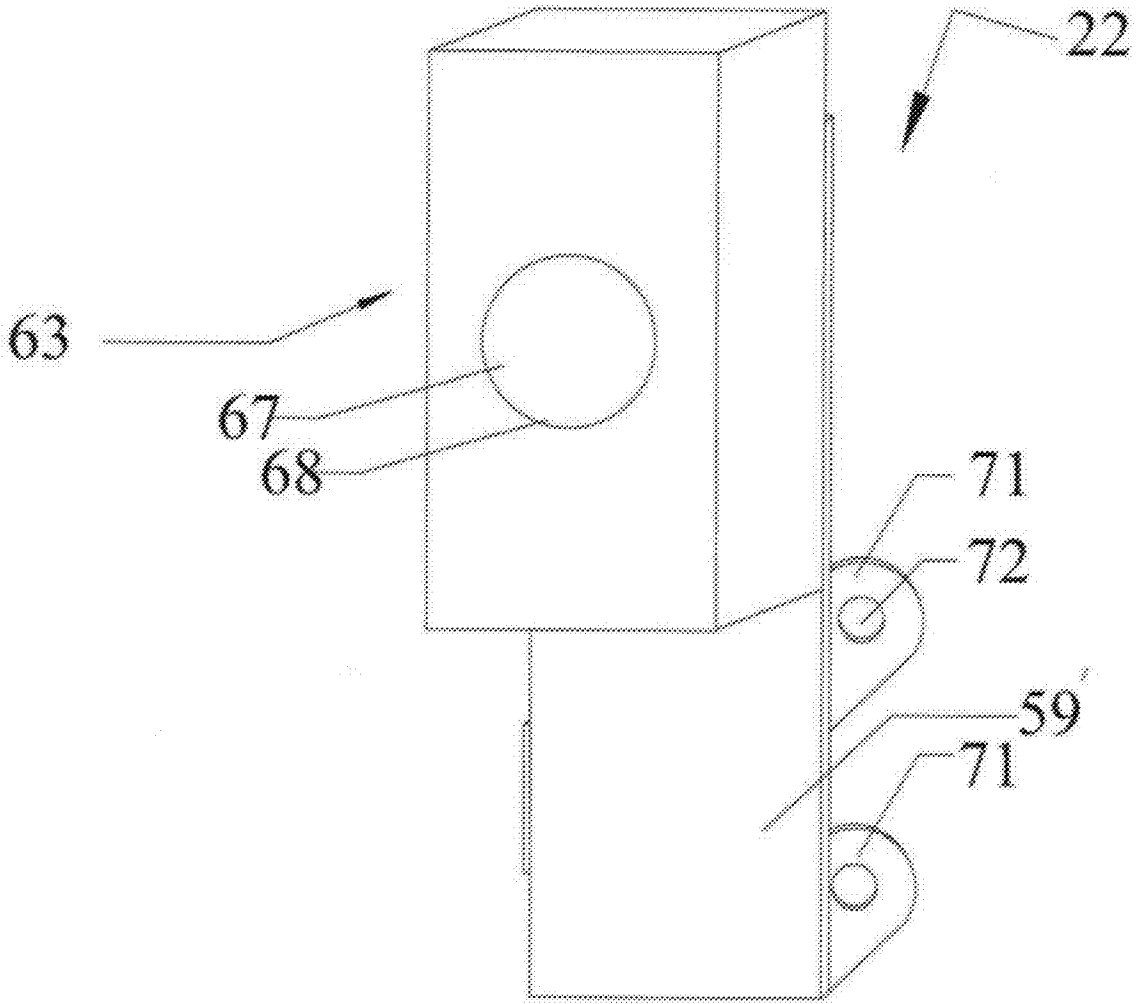
FIG. 6 is another alternate arrangement of a tilt indicator of the device of this invention.

Referring now to FIG. 6, where tilt indicator 22 is provided with a single light 67, single light 67 will have at least two different colored light sources therebehind wherein the separate light sources will respond to signals from electrical contact switches 51, 52. For instance, when electrical contact switch 52 has follower 54 disposed into forward tilt groove 7 and follower 53 of electrical contact switch 51 is riding upon surface 55 of indicating rod 9, a forward attitude is indicated and light 67 may be changed to a red color. Otherwise, when electrical contact switch 51 has follower 53 disposed into rearward tilt groove 6 and follower 54 of electrical contact switch 52 is riding upon surface 56 of indicating rod 9, a rearward or backward attitude is indicated and light 67 may be changed to a green color. If both followers 53, 54 are riding upon respective surfaces 55, 56, a null, central or vertical condition is present and light 67 may be switched off or changed to a color other than green or red indicating that forks 28 are level with surface 21.

Figure 7:
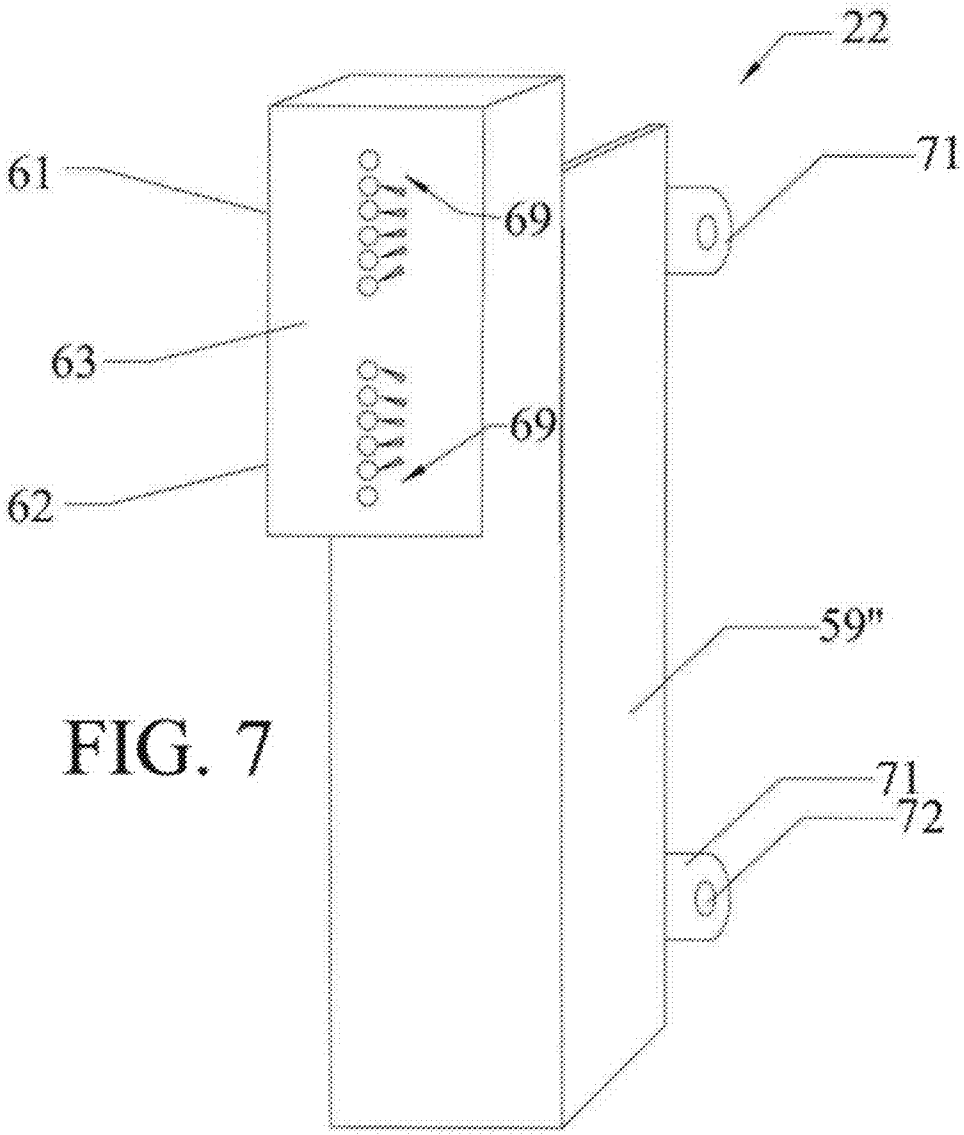
FIG. 7 is a third alternate arrangement of a tilt indicator of the device of this invention.

Referring now to FIG. 7, tilt indicator 22 may be provided with two lights 61, 62, wherein light 61 is comprised of a plurality of light sources such as LED's 69 arranged in an array above a null section 63 and light 62 also comprises a plurality of light sources such as LED's 69 arranged in an array below null section 63. Top light 61 will have at least one LED lighted when forks 28 are tilted back from a vertical position while bottom light 62 would have at least one LED lighted when forks 28 are tilted downwardly from a vertical. Central section 63 would then comprise a null section where no light is provided and the operator would know that when no LED of either light 61 or 62 is lighted, forks 28 are substantially level with surface 21 upon which wheels 19 of forklift 11 are riding. A plurality of LED's 69 is provided to ensure that at least one LED 69 is lighted for each indicated condition and thus a plurality of LED's 69 provides redundancy to tilt indicator 22.

Referring back to FIG. 6, tilt indicator 22 may comprise a speaker 68 in place of light 67, speaker 68 providing an audible signal for a tilt condition of forks 28. For instance when forks 28 are tilted downwardly, speaker 68 could sound a low frequency sound at a specified amplitude while when forks 28 are tilted upwardly, speaker 68 could sound a higher frequency sound at the same specified amplitude. Though a given amplitude may be sufficient, it may also be beneficial to change the amplitude of high and low frequency sounds to ensure that an operator is fully aware of the condition of forks 28.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A device for determining vertical orientation of a fork of a forklift, said forklift comprising a frame, a fork assembly, a tilting piston assembly, an operator compartment, a prime mover and surface engaging wheels, said fork assembly pivotally attached to said frame, said fork assembly further comprising a column, a telescoping structure and a pair of forks, said pair of forks movable upon said telescoping structure, said telescoping structure moveable upon said column, said piston assembly comprising a piston and a cylinder, said cylinder pivotally attached to said frame, said piston having one end longitudinally movable within said cylinder and an opposite end of said piston coupled to said fork assembly with a pivotable coupling, said device comprising:

an indicating rod, a electrical contact switch assembly, an tilt indicator, a mounting lug and connecting wires, said mounting lug having a hole disposed longitudinally therethrough, said electrical contact switch assembly rigidly mounted to said cylinder, said indicating rod having a forward end adjustably attached to said pivotable coupling in said mounting lug, said indicating rod disposed parallel to said piston and passing through said electrical contact switch assembly, said indicating rod having a central cylindrical portion, a forward tilt groove, a rearward tilt groove and an end cylindrical portion, said forward tilt groove disposed aft of said central cylindrical portion, said rearward tilt groove disposed between said central cylindrical portion and said end cylindrical portion, said forward tilt groove disposed diametrically opposite said rearward tilt groove, said electrical contact switch comprising a pair of electrical contactors disposed in opposed relationship wherein one said electrical contact switch has a follower adapted to travel on said indicating rod diametrically opposite a follower of another said electrical contact switch, said follower of said one electrical contact switch aligned with said forward tilt groove and said follower of said another electrical contact switch aligned with said rearward tilt groove, said tilt indicator mounted in said operator compartment and electrically coupled to said electrical contact switch assembly with said connecting wires, said tilt indicator providing an operator with an orientation of said forks relative to a surface engaged with said surface engaging wheels.

2. A device as in claim 1 wherein a central orientation of said forks is established by placing said forks flat upon said surface, adjustably moving said indicating rod in said mounting lug wherein said follower of said one electrical contact switch and said follower of said another electrical contact switch are disposed on said central cylindrical portion of said indicating rod.

3. A device as in claim 2 wherein said hole is cylindrical and is disposed longitudinally through said mounting lug.

4. A device as in claim 3 wherein said mounting lug further comprises a pinching clamp, said pinching clamp comprising a slit and a clamping screw, said slit disposed through a sidewall of said mounting lug and into said hole, said clamping screw disposed into said mounting block at an angle to said slit wherein said hole is adjustable in diameter by closing said slit with said clamping screw.

5. A device as in claim 2 wherein said tilt indicator comprises a light adapted to change color relative to a position of said indicating rod.

6. A device as in claim 2 wherein said tilt indicator comprises a pair of lights disposed one above the other wherein a top one of said lights is on when said follower of said one electrical contact switch is disposed into said forward tilt groove of said indicating rod.

7. A device as in claim 6 wherein a bottom one of said lights is on when said follower of said another electrical contact switch is disposed in said rearward tilt groove of said indicating rod.

8. A device as in claim 7 wherein said bottom one of said lights and said top one of said lights is off when said follower of said another electrical contact switch and said follower of said one electrical contact switch are disposed on said central cylindrical portion of said indicating rod.

9. A device as in claim 2 wherein said tilt indicator comprises an audible signal relative to a position of said indicating rod.

10. A device as in claim 9 wherein said audible signal comprises a tone of high frequency only when said follower of said one electrical contact switch is disposed into said forward tilt groove of said indicating rod.

11. A device as in claim 10 wherein audible signal comprises a tone of low frequency only when said follower of said another electrical contact switch is disposed in said rearward tilt groove of said indicating rod.

12. A device as in claim 3 wherein said hole is threaded longitudinally through said mounting lug, said end cylindrical portion is threaded and said central orientation of said forks established by threadedly adjusting said indicating rod in said hole in said mounting lug.

13. A device as in claim 3 wherein said hole is disposed longitudinally through said mounting lug, said terminal cylindrical portion is threaded, a pair of cooperating nuts are threaded upon said threaded cylindrical portion, one said nut disposed on one side of said mounting lug and another nut disposed on an opposite side of said mounting lug, said central orientation of said forks established by moving said indicating rod through said hole in said mounting lug by threadedly adjusting said cooperating nuts against said sides of said mounting lug.

14. A device for determining vertical orientation of a fork of a forklift, said forklift comprising a frame, a fork assembly, a tilting piston assembly, an operator compartment, a prime mover and surface engaging wheels, said fork assembly pivotally attached to said frame, said fork assembly further comprising a column, a telescoping structure and a pair of forks, said pair of forks movable upon said telescoping structure, said telescoping structure moveable upon said column, said piston assembly comprising a piston and a cylinder, said cylinder pivotally attached to said frame, said piston having one end longitudinally movable within said cylinder and an opposite end thereof coupled to said fork assembly with a pivotable coupling, said device comprising:

an indicating rod, a electrical contact switch assembly, an tilt indicator, a mounting lug and connecting wires, said mounting lug having a hole disposed longitudinally therethrough, said electrical contact switch assembly rigidly mounted to said cylinder, said indicating rod having a forward end adjustably attached to said pivotable coupling with said mounting lug, said indicating rod disposed parallel to said piston and passing through said electrical contact switch assembly, said indicating rod having a central cylindrical portion, a forward tilt groove and a rearward tilt groove, said forward tilt groove disposed aft of said central cylindrical portion, said rearward tilt groove disposed between said central cylindrical portion and said end cylindrical portion, said forward tilt groove disposed diametrically opposite said rearward tilt groove, said electrical contact switch comprising a pair of electrical contactors disposed in opposed relationship wherein one said electrical contact switch has a follower adapted to travel on said indicating rod diametrically opposite a follower of another said electrical contact switch, said follower of said one electrical contact switch aligned with said forward tilt groove and said follower of said another electrical contact switch aligned with said rearward tilt groove, said tilt indicator mounted in said operator compartment and electrically coupled to said electrical contact switch assembly with said connecting wires, said tilt indicator providing an operator with an orientation of said forks relative to a surface engaged by said surface engaging wheels.

15. A device as in claim 14 wherein said hole is disposed longitudinally through said mounting lug and corresponds in shape to said rearward tilt groove.

16. A device as in claim 15 wherein said mounting lug is provided with at least one set screw threaded into one side of said mounting lug, said set screw adapted to be tightened against said indicating rod in said rearward tilt groove.

17. In combination, a fork lift and a device for determining vertical orientation of forks of a forklift, said forklift comprising a frame, a fork assembly, a tilting piston assembly, an operator compartment, a prime mover and surface engaging wheels, said fork assembly pivotally attached to said frame, said fork assembly further comprising a column, a telescoping structure and a pair of forks, said pair of forks movable upon said telescoping structure, said telescoping structure moveable upon said column, said piston assembly comprising a piston and a cylinder, said cylinder pivotally attached to said frame, said piston having one end longitudinally movable within said cylinder and an opposite end of said piston coupled to said fork assembly with a pivotable coupling, said device comprising:

an indicating rod, a electrical contact switch assembly, an tilt indicator, a mounting lug and connecting wires, said mounting lug having a hole disposed longitudinally therethrough, said electrical contact switch assembly rigidly mounted to said cylinder, said indicating rod having a forward end adjustably attached to said pivotable coupling in said mounting lug, said indicating rod disposed parallel to said piston and passing through said electrical contact switch assembly, said indicating rod having a central cylindrical portion, a forward tilt groove, a rearward tilt groove and an end cylindrical portion, said forward tilt groove disposed aft of said central cylindrical portion, said rearward tilt groove disposed between said central cylindrical portion and said end cylindrical portion, said forward tilt groove disposed diametrically opposite said rearward tilt groove, said electrical contact switch comprising a pair of electrical contactors disposed in opposed relationship wherein one said electrical contact switch has a follower adapted to travel on said indicating rod diametrically opposite a follower of another said electrical contact switch, said follower of said one electrical contact switch aligned with said forward tilt groove and said follower of said another electrical contact switch aligned with said rearward tilt groove, said tilt indicator mounted in said operator compartment and electrically coupled to said electrical contact switch assembly with said connecting wires, said tilt indicator providing an operator with an orientation of said forks relative to a surface supporting said forklift.

18. A combination as claimed in claim 17 wherein said tilt indicator comprises a plurality of lights arranged in a vertical column and wherein a first portion of said plurality of lights is arranged in said column above a central null section, said central null section devoid of said lights and a second portion of said plurality of lights arranged in said column below said central null section.

19. A combination as claimed in claim 18 wherein said first portion of lights is one color.

20. A combination as claimed in claim 19 wherein said second portion of lights is a contrasting color.

* * * * *